US010295195B2

(12) United States Patent
Kim et al.

(10) Patent No.: US 10,295,195 B2
(45) Date of Patent: May 21, 2019

(54) COOKING DEVICE

(71) Applicant: LG Electronics Inc., Seoul (KR)

(72) Inventors: Wontae Kim, Seoul (KR); Sangcheol Lee, Seoul (KR); Wansoo Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 349 days.

(21) Appl. No.: 15/075,618

(22) Filed: Mar. 21, 2016

(65) Prior Publication Data

US 2016/0273779 A1 Sep. 22, 2016

(30) Foreign Application Priority Data

Mar. 19, 2015 (KR) ..... 10-2015-0037966
Feb. 23, 2016 (KR) ..... 10-2016-0021130

(51) Int. Cl.
*F24C 15/20* (2006.01)
*H05B 6/64* (2006.01)

(52) U.S. Cl.
CPC ..... *F24C 15/2042* (2013.01); *F24C 15/20* (2013.01); *F24C 15/2028* (2013.01); *F24C 15/2092* (2013.01); *H05B 6/6423* (2013.01)

(58) Field of Classification Search
CPC .. F24C 15/2042; F24C 15/20; F24C 15/2092; H05B 6/6423
See application file for complete search history.

(56) References Cited

U.S. PATENT DOCUMENTS 5,537,988 A * 7/1996 Lin ..... F24C 15/20 126/299 D
2008/0156793 A1* 7/2008 Song ..... H05B 6/6423 219/757
2010/0200576 A1 8/2010 Song et al.

FOREIGN PATENT DOCUMENTS

| | | |
|---|---|---|
| EP | 1365196 | 11/2003 |
| EP | 3023702 | 5/2016 |
| JP | 03720452 | 11/2005 |
| JP | 2015-045308 | 3/2015 |
| KR | 10-2000-0051144 | 8/2000 |
| KR | 10-2004-0008853 | 1/2004 |
| KR | 10-2008-0063568 | 7/2008 |
| WO | 2012/102462 | 8/2012 |

OTHER PUBLICATIONS

International Search Report in International Application No. PCT/KR2016/002532, dated Jun. 23, 2016, 3 pages.
European Extended Search Report in European Application No. 16765224.7, dated Oct. 11, 2018, 12 pages.

* cited by examiner

*Primary Examiner* — Alfred Basichas
(74) *Attorney, Agent, or Firm* — Fish & Richardson P.C.

(57) ABSTRACT

A cooking device includes a main body having a cooking space for cooking food; a base disposed at a lower side of the main body, and comprising a ventilation apparatus for suctioning and discharging contaminated air, the ventilation apparatus being connected to the lower side of the main body and having an introduction port; a swirler rotated so that the contaminated air is suctioned through the introduction port of the base, and having a plurality of wings; an installation part provided at the base; and a driving motor installed at the installation part and configured to generate power for rotating the swirler.

14 Claims, 18 Drawing Sheets

COOKING DEVICE

CROSS-REFERENCE TO RELATED APPLICATION(S)

This application claims priority under 35 U.S.C. § 119 and 35 U.S.C. § 365 to Korean Patent Application No. 10-2015-0037966, filed in Korea on Mar. 19, 2015 and Korean Patent Application No. 10-2016-0021130, filed in Korea on Feb. 23, 2016, whose entire disclosure are hereby incorporated by reference.

BACKGROUND

1. Field

A cooking device is disclosed herein.

2. Background

Generally, a cooking device is a home appliance which cooks food using a heating source. Among such cooking devices, a cooking device with a hood function may be referred to as a cooking device with a hood.

The cooking device with the hood is installed at one side of a kitchen. For example, the cooking device with the hood is installed above another cooking device, e.g., a gas oven range, and may suction contaminated air generated during a cooking process in the other cooking device such as the gas oven range.

In a first prior art document (Korean Patent Publication No. 10-2008-0091607 published on Oct. 14, 2008), there is disclosed a wall-mounted microwave oven.

The wall-mounted microwave oven disclosed in the first prior art document includes a main body in which a ventilation path is formed, and a fan motor assembly which is installed at the ventilation path.

And an opening part is formed at a lower side of the main body, and thus contaminated air in a kitchen may be introduced into the ventilation path.

In a second prior art document (Korean Patent Publication No. 2008-0094412 published on Oct. 13, 2008), there is disclosed a swirl type local ventilation apparatus.

The local ventilation apparatus disclosed in the second prior art document moves and suctions contaminants using an exhaust pipe, a driving part which is installed in the exhaust pipe, a rotating plate which is rotated by the driving part, and a swirler which has a plurality of wings provided at an edge of the rotating plate.

However, in the case of the first prior art document, since a distance between the opening part and the fan motor assembly is long, a loss of a suction force generated from the fan motor assembly occurs while the suction force is transferred to the opening part, and suction performance at the opening part is degraded.

And a gas oven range may be located under the wall-mounted microwave oven disclosed in the first prior art document. The gas oven range may include a front side heating part and a rear side heating part.

In general, since a forward and backward length of the gas oven range is formed longer than that of the wall-mounted microwave oven, some or all of contaminated air generated while food is cooked by the front side heating part of the gas oven range may not be suctioned into the opening part of the wall-mounted microwave oven, and thus the contaminated air may rise and spread widely in the kitchen.

Meanwhile, in the case of the second prior art document, since the driving part is installed in the exhaust pipe aligned with a hole formed at the swirler, a length of the exhaust pipe in which the driving part is installed is long, and thus there is limitation in an installation position of the local ventilation apparatus.

Also, since the driving part is installed in the exhaust pipe, when the local ventilation apparatus is once installed, it is difficult to repair and replace the driving part.

Meanwhile, the ventilation apparatus of the second prior art document may be applied to the first prior art document. In this case, a height of the wall-mounted microwave oven disclosed in the first prior art document is increased, and thus there is limitation in a space which is provided under the wall-mounted microwave oven to locate the food or a cooking container.

Also, when only the swirler of the second prior art document may be applied to the first prior art document, there is still a problem that the contaminated air generated while the food is cooked by the front side heating part of the gas oven range may not be effectively suctioned.

Also, there has been no attempt to apply the ventilation apparatus having the swirler to the wall-mounted microwave oven of the first prior art document. This is caused by a cost problem and a shortage problem of a space for applying the ventilation apparatus to the wall-mounted microwave oven.

SUMMARY

The present disclosure is directed to a cooking device in which air introduction performance is enhanced by using a ventilation apparatus forming swirl.

A cooking device includes a main body having a cooking space for cooking food; a base disposed at a lower side of the main body, and including a ventilation apparatus for suctioning and discharging contaminated air, the ventilation apparatus being connected to the lower side of the main body and having an introduction port; a swirler rotated so that the contaminated air is suctioned through the introduction port of the base, and having a plurality of wings; an installation part provided at the base; and a driving motor installed at the installation part and configured to generate power for rotating the swirler.

A cooking device includes a main body having a cooking space for cooking food; a base disposed at a lower side of the main body, and including a ventilation apparatus for suctioning and discharging contaminated air, the ventilation apparatus being connected to the lower side of the main body and having an introduction port; a swirler rotated so that the contaminated air is suctioned through the introduction port of the base, and having a plurality of wings; a driving motor installed at the base and configured to generate power for rotating the swirler; and a movable member connected to the base to be inserted and withdrawn, and configured to block rising of the contaminated air generated when food is cooked by a lower cooking device located under the ventilation apparatus, while being withdrawn from the base.

A cooking device includes a main body having a cooking space for cooking food; a base disposed at a lower side of the main body, and comprising a ventilation apparatus for suctioning and discharging contaminated air, the ventilation apparatus being connected to the lower side of the main body and having an introduction port; a swirler configured to enable air around the base to be introduced through the introduction port of the base, to radially push out some of the flowing air, and to form swirl under the base; and a movable member withdrawn from the base, and configured to block rising of the air so that at least some of the air flows to the introduction port by the swirl.

BRIEF DESCRIPTION OF THE DRAWINGS

Embodiments will be described in detail with reference to the following drawings in which like reference numerals refer to like elements, and wherein.

DETAILED DESCRIPTION

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustrating specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 1:
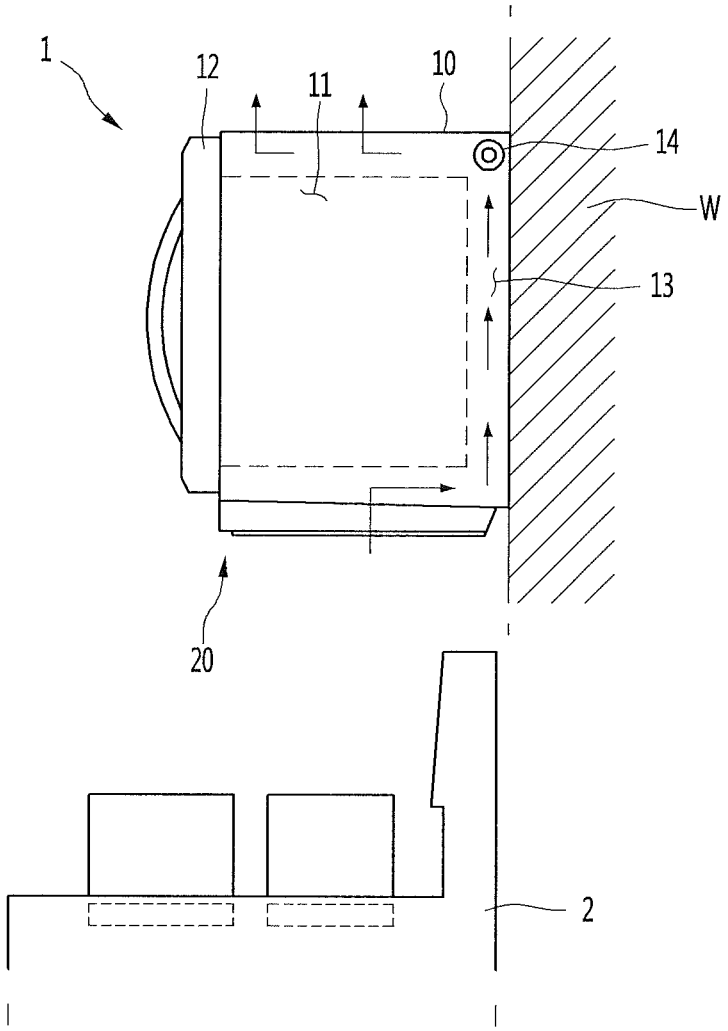
FIG. 1 is a view of a cooking device according to a first embodiment of the present invention.

FIG. 1 is a view of a cooking device according to a first embodiment of the present invention.

Referring to FIG. 1, a cooking device 1 according to the first embodiment of the present invention may be installed at, for example, a wall W of a kitchen. That is, the cooking device 1 according to the embodiment of the present invention may be a wall-mounted microwave oven. Of course, as long as the cooking device 1 can be installed at the wall W, a type of the cooking device 1 is not limited.

The cooking device 1 may include the main body 10 having the cooking space 11, and the door 12 which is connected with the main body 10 to open and close the cooking space 11. Therefore, the cooking device 1 may perform cooking of food accommodated in the cooking space 11.

For example, the cooking device 1 may be located above another cooking device 2 (hereinafter, referred to as a "lower cooking device") in the kitchen.

While the food is cooked by the lower cooking device 2, air around the lower cooking device 2 is contaminated, and the contaminated air has a higher temperature than that of other air therearound, and thus rises.

When the contaminated air rises and remains in the kitchen in which the cooking devices 1 and 2 are located, a pleasant environment in the kitchen is degraded, and smell contained in the contaminated air permeates the kitchen, and thus long hours of ventilation is required.

Therefore, the cooking device 1 may further include a ventilation apparatus 20 which suctions the contaminated air generated while the food is cooked by the lower cooking device 2 and discharges the suctioned air to an outside of the cooking device 1.

The ventilation apparatus 20 may be disposed at a lower side of the main body 10, but is not limited thereto. The main body 10 may have an exhaust port (not shown) through which air flowing in the ventilation apparatus 20 is discharged.

And the main body 10 may further include a suction fan 14 which is operated to suction the contaminated air, and an air path 13 through which the contaminated air flows.

Therefore, the contaminated air suctioned by the ventilation apparatus 20 may flow through the air path 13 inside the main body 10, and then may be discharged through the exhaust port. In this case, although not illustrated, one or more filters for filtering the air or removing the smell may be provided at the air path 13 of the cooking device 1. Alternatively, in a state in which the ventilation apparatus 20 is installed at the main body 10, the ventilation apparatus 20 may be disposed so that the exhaust port thereof is in communication with an exhaust hole formed at the wall.

The ventilation apparatus 20 may be operated separately from a cooking operation in the main body 10. That is, only the cooking operation may be performed in the cooking device 1, only a ventilating operation may be performed in the cooking device 1 by the ventilation apparatus 20, or the cooking and ventilating operations may be simultaneously performed.

Hereinafter, the ventilation apparatus 20 will be described in detail.

Figure 2:
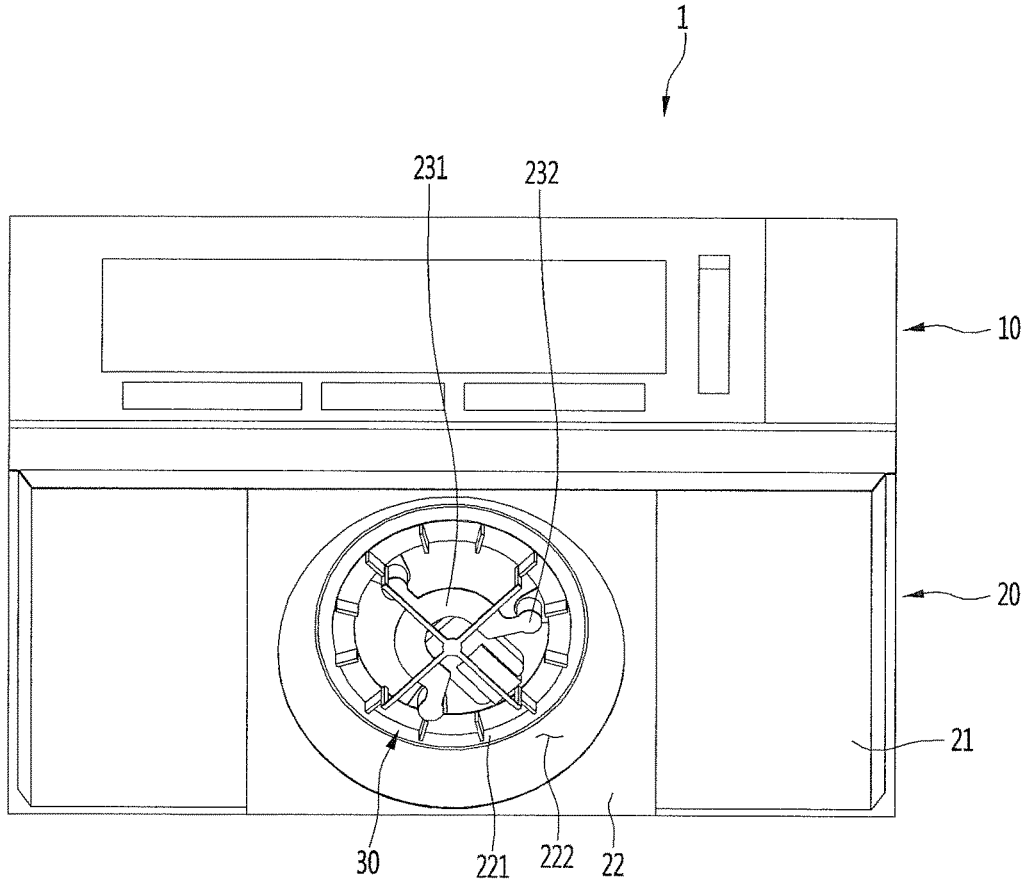
FIG. 2 is a view of the cooking device according to the first embodiment of the present invention, when being seen from a lower side thereof.
Figure 3:
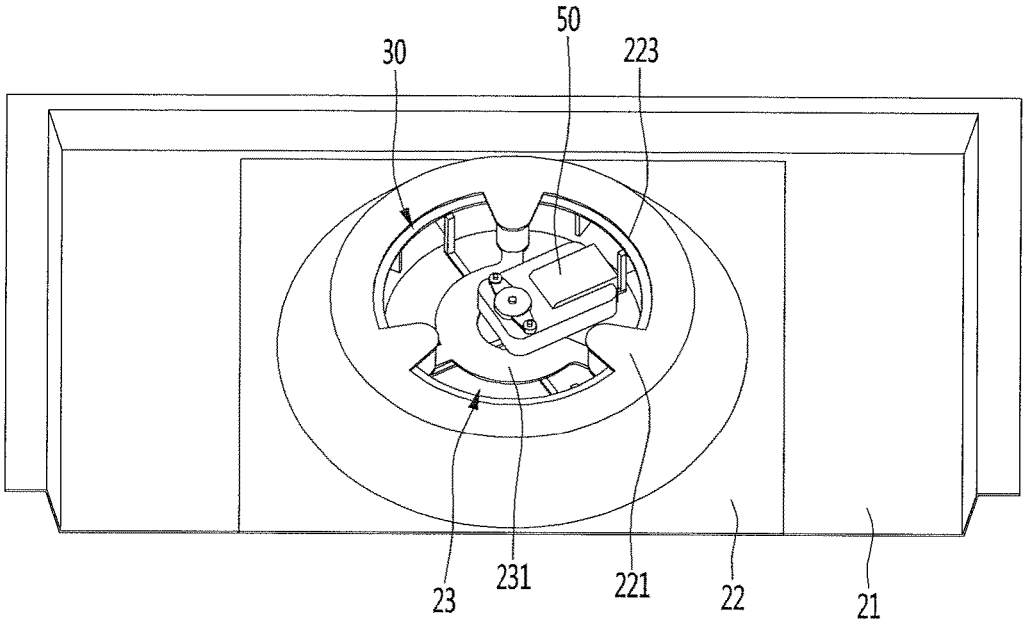
FIG. 3 is a view of an ventilation apparatus according to the first embodiment of the present invention, when being seen from an upper side thereof.
Figure 4:
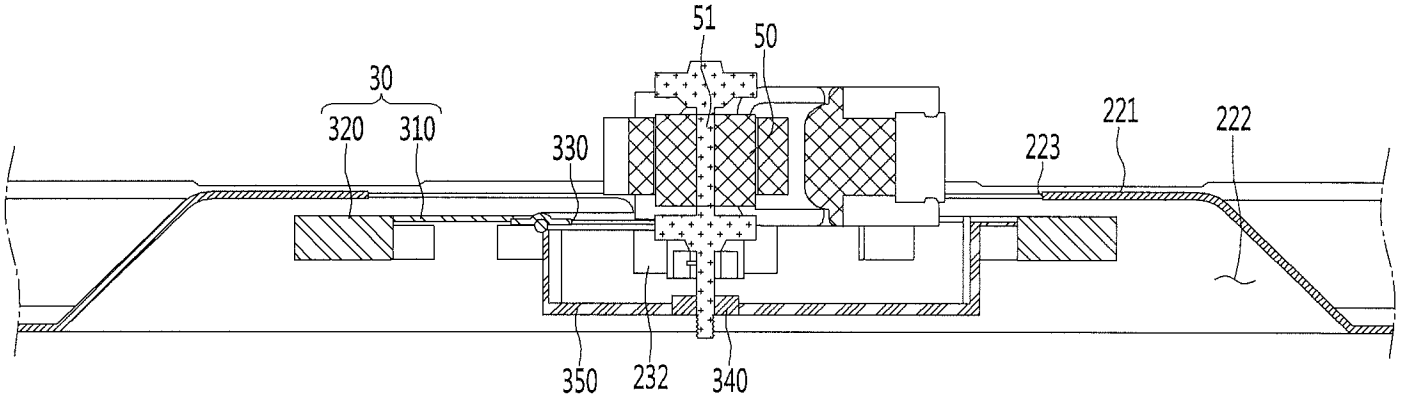
FIG. 4 is a vertical cross-sectional view of the ventilation apparatus according to the first embodiment of the present invention.

FIG. 2 is a view of the ventilation apparatus according to the first embodiment of the present invention, when being seen from a lower side thereof, FIG. 3 is a view of the ventilation apparatus according to the first embodiment of the present invention, when being seen from an upper side thereof, and FIG. 4 is a vertical cross-sectional view of the ventilation apparatus according to the first embodiment of the present invention.

Referring to FIGS. 2 to 4, the ventilation apparatus 20 according to the first embodiment of the present invention may include a base 21 which provides a path of the contaminated air.

The base 21 may be coupled to the lower side of the main body 10. Since the base 21 forms a lower exterior of the cooking device 1, and also provides the path of the contaminated air, there is an advantage that a structure of the ventilation apparatus 20 becomes simple.

The base 21 may include a flow guide 22 having an introduction port 223 through which the air is introduced. The flow guide 22 may be fastened to the base 21 by a fastening member, or may be integrally formed with the base 21.

The ventilation apparatus 20 may further include a driving motor 50, and a swirler 30 which receives power from the driving motor 50 so as to be rotated.

The swirler 30 may include a rotary plate 310 which is rotated, and a plurality of wings 320 which are disposed along an edge of the rotary plate 310 in a circumferential direction thereof. At this time, each of the plurality of wings 320 may extend downward from a lower surface of the rotary plate 310 in order to radially push out some of the air before the air passes through the rotary plate 310.

The swirler 30 may be located at a space 222 formed by the flow guide 22. And the swirler 30 may be located under the introduction port 223 so that swirl (or vortex) is formed under the flow guide 22 by the swirler 30.

A hole 330 through which the contaminated air passes may be formed at the rotary plate 310. And for a smooth flow of the contaminated air, the hole 330 may be disposed to be vertically overlapped with the introduction port 223 of the base 21.

The swirler 30 may further include a shaft coupling part 340 for connection with a shaft 51 of the driving motor 50, and one or more connection ribs 350 which connect the shaft coupling part 340 with the rotary plate 310.

The driving motor 50 may be installed at an installation part 23 which is provided at the flow guide 22. That is, the driving motor 50 may be directly installed at the base 21.

The flow guide 22 may include a recessed portion 221 which guides the flow of the air. For example, the introduction port 223 may be formed at the recessed portion 221. Due to the recessed portion 221, the flow guide 22 may include a guide surface which is inclined downward outward.

When the air which is radially pushed out by the plurality of wings 320 flows downward in a direction which becomes far away radially, the swirl may be formed under the flow guide 22.

According to the embodiment, since the flow guide 22 includes the guide surface which is inclined downward outward, the air which is radially pushed out may be smoothly flow downward, and thus the swirl may be smoothly formed under the swirler 30.

The installation part 23 may include a supporter 231 which is fastened to the driving motor 50 so as to support the driving motor 50, and a connection portion 232 which connects the supporter 231 with the flow guide 22.

The supporter 231 may be located lower than the introduction port 223. Therefore, while the driving motor 50 is installed at the supporter 231, the driving motor 50 may pass through the introduction port 223.

The driving motor 50 may be fastened to the supporter 231 at an upper side of the supporter 231.

Therefore, a part of the driving motor 50 may be located above the introduction port 223, and the other part thereof may be located under the introduction port 223.

According to the embodiment, since the driving motor 50 is installed at the installation part 23 which is provided at the base 21, there are some advantages that the driving motor 50 may be easily installed, and a height of the ventilation apparatus 20 may be reduced.

In particular, since the driving motor 50 passes through the introduction port 223 of the base 21, and is located under the introduction port 223, the height of the ventilation apparatus 20 may be further reduced.

In order for the driving motor 50 to pass through the introduction port 223, at least a part of the supporter 231 may be located to be vertically overlapped with the introduction port 223.

At this time, to enable the supporter 231 to stably support the driving motor 50 and also to minimize flow resistance due to the supporter 231, the supporter 231 may be formed in a "C" shape.

The shaft coupling part 340 of the swirler 30 may be located under the rotary plate 310.

Therefore, the shaft 51 of the driving motor 50 may pass through the hole 330 of the rotary plate 310, and then may be connected to the shaft coupling part 340. At this time, a part of the driving motor 50 may also pass through the hole 330 of the rotary plate 310.

The shaft coupling part 340 may be located lower than the plurality of wings 320. And the shaft coupling part 340 may be located within the space 222 formed by the recessed portion 221.

The supporter 231 may be located above the shaft coupling part 340. The supporter 231 may pass through the hole 330 of the rotary plate 310, but is not limited thereto.

According to the embodiment, since the shaft coupling part 340 is connected to the shaft 51 of the driving motor 50 while being located under the rotary plate 310, a distance between the swirler 30 and the driving motor 50 is minimized, and thus the height of the ventilation apparatus 20 may be reduced.

Hereinafter, an operation of the ventilation apparatus 20 will be described.

Figure 5:
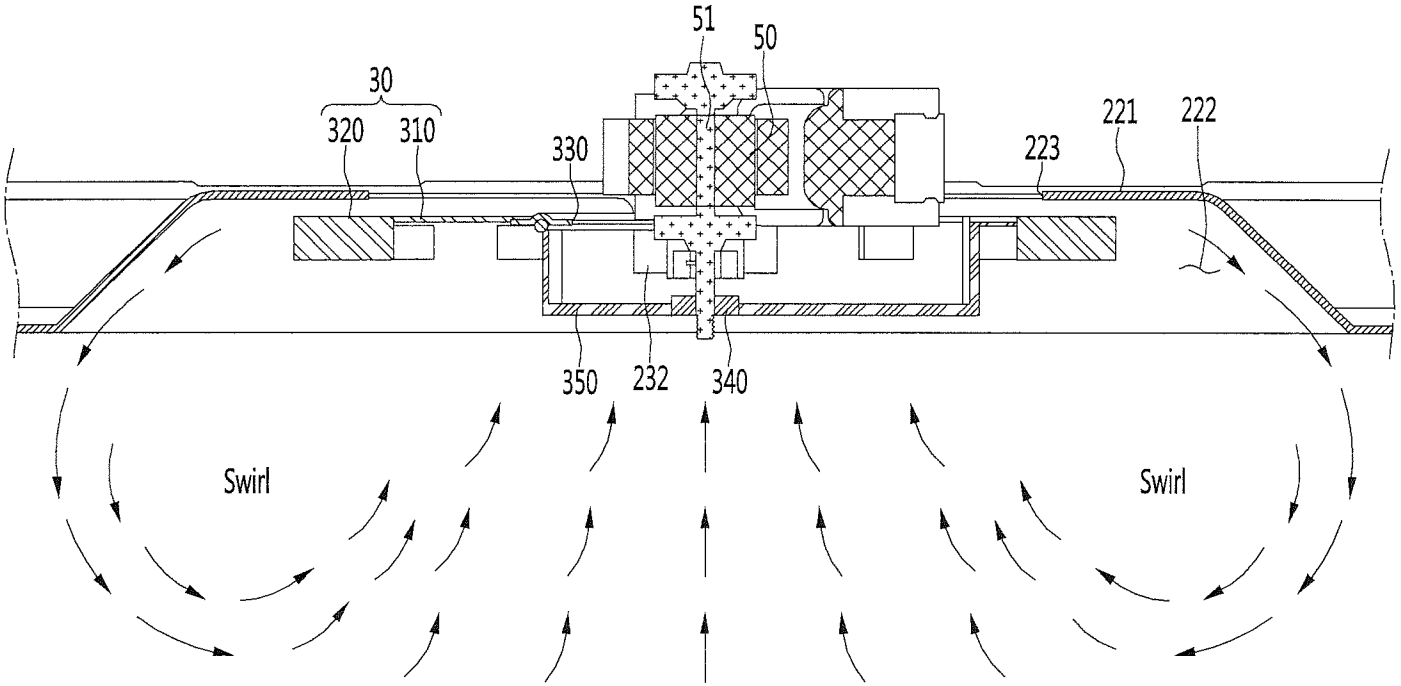
FIG. 5 is a view illustrating a flow of air generated when the ventilation apparatus according to the first embodiment of the present invention is operated.

FIG. 5 is a view illustrating the flow of the air generated when the ventilation apparatus according to the first embodiment of the present invention is operated.

Referring to FIG. 5, when an operation command of the ventilation apparatus 20 is input, the driving motor 50 is turned on. When the driving motor 50 is turned on, the swirler 30 is rotated in one direction.

When the swirler 30 is rotated in one direction, the wings 320 of the swirler 30 push outward the contaminated air flowing toward the hole 330 of the rotary plate 310 in a radial direction of the rotary plate 310. And when the air passes through the introduction port 223 of the base 21, not only the contaminated air passing through the introduction port 223 but also air therearound are intended to pass through the introduction port 223 of the base 21. Due to such a flow of the air, the swirl is formed under the rotary plate 310.

When the swirl is formed under the swirler 30 by the swirler 30 and the flow guide 22, as described above, the contaminated air which rises from a lower side of the cooking device 1 may be smoothly inserted into the ventilation apparatus 20.

At this time, in the case of the embodiment, since the flow guide 22 of the base 21 guides downward the air flowing in the radial direction of the swirler 30, the swirl may be effectively formed.

Figure 6:
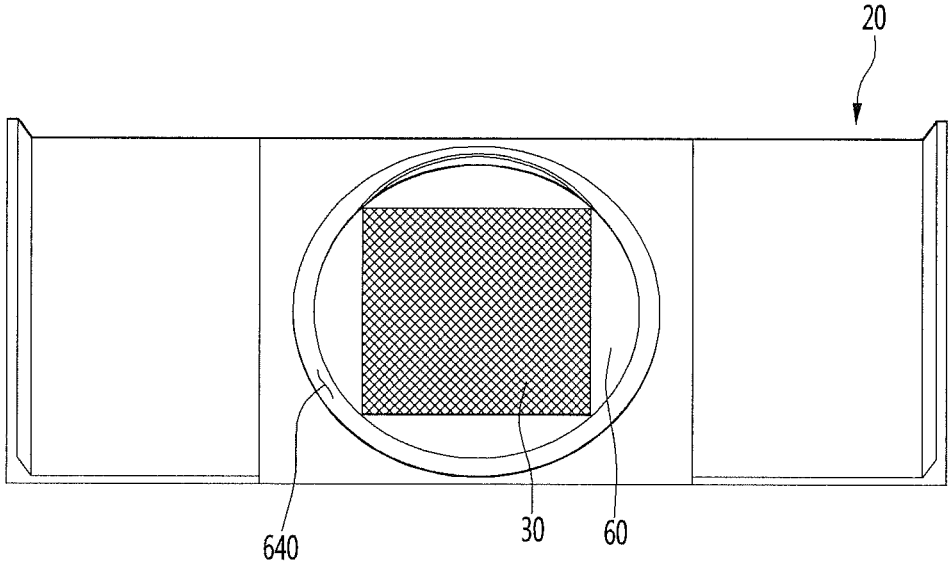
FIG. 6 is a view of the ventilation apparatus according to the second embodiment of the present invention, when being seen from a lower side thereof.
Figure 7:
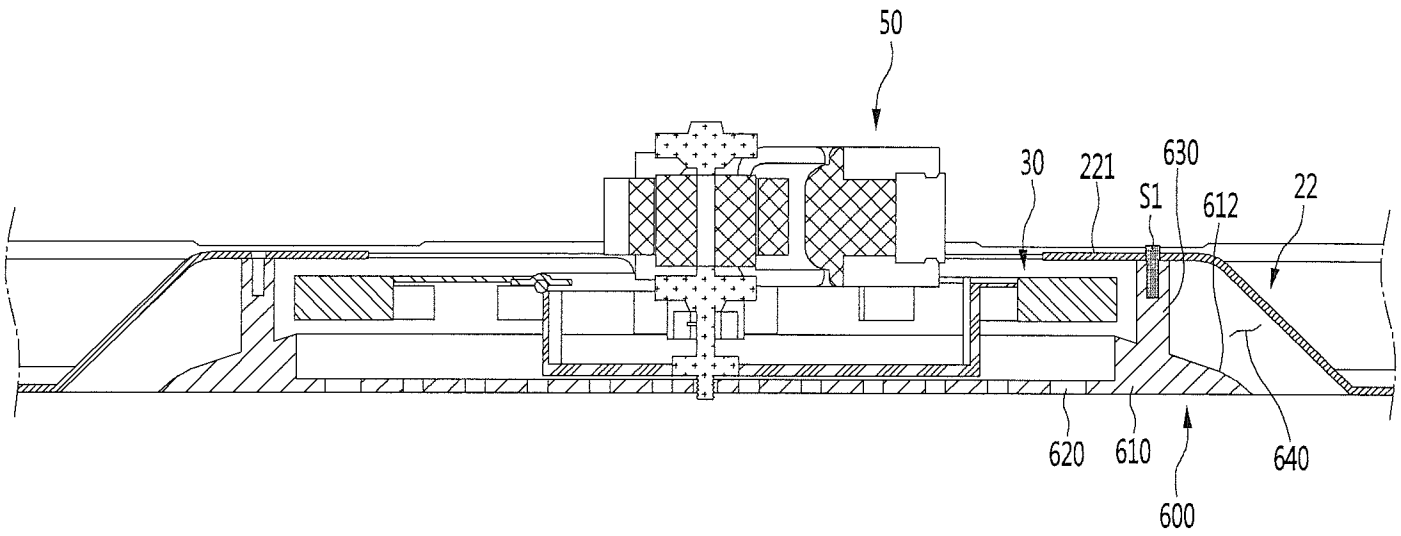
FIG. 7 is a vertical cross-sectional view of a ventilation apparatus according to a second embodiment of the present invention.

FIG. 6 is a view of a ventilation apparatus according to a second embodiment of the present invention, when being seen from a lower side thereof, and FIG. 7 is a vertical cross-sectional view of the ventilation apparatus according to the second embodiment of the present invention.

The embodiment is the same as the first embodiment, except that a filter unit which filters the air before the air passes through the introduction port of the base is further included. Therefore, hereinafter, only a characteristic portion of the embodiment will be described.

Referring to FIGS. 6 and 7, a ventilation apparatus 20 according to the second embodiment may further include a filter unit 60 which is installed at the base 21.

The filter unit 60 may include a filter bracket 610, and a filter 620 which is supported by the filter bracket 610.

The filter bracket 610 may be fastened to the base 21, e.g., the flow guide 22. The filter bracket 610 may include a fastening boss 630, and a fastening member S1 passed through the flow guide 22 may be fastened to the fastening boss 630.

The filter bracket 610 may be spaced apart from the flow guide 22 while being installed at the flow guide 22. And to prevent interference between the filter bracket 610 and the swirler 30, the filter bracket 610 may be located under the swirler 30.

Therefore, the filter unit 60 may cover the swirler 30, and may prevent the swirler 30 from being exposed to an outside.

A discharge path 640 may be formed between the filter bracket 610 and the flow guide 22.

The filter bracket 610 may include a guide surface 612 which guides the air flowing through the discharge path 640. The guide surface 612 may be an inclined surface formed to be rounded.

Due to the guide surface 612, the air flowing by the swirler 30 may smoothly flow downward by a Coanda effect.

When the air flowing by the swirler 30 smoothly flows downward, the swirl may be easily formed, and thus suction performance of the ventilation apparatus 20 may be enhanced. Also, when the air flowing by the swirler 30 smoothly flows downward, an area in which the swirl is formed may be increased, and thus the suction performance of the ventilation apparatus 20 may be enhanced.

Also, according to the embodiment, the swirler 30 is prevented by the filter unit 60 from being exposed to the outside, and thus safety may be enhanced.

Figure 8:
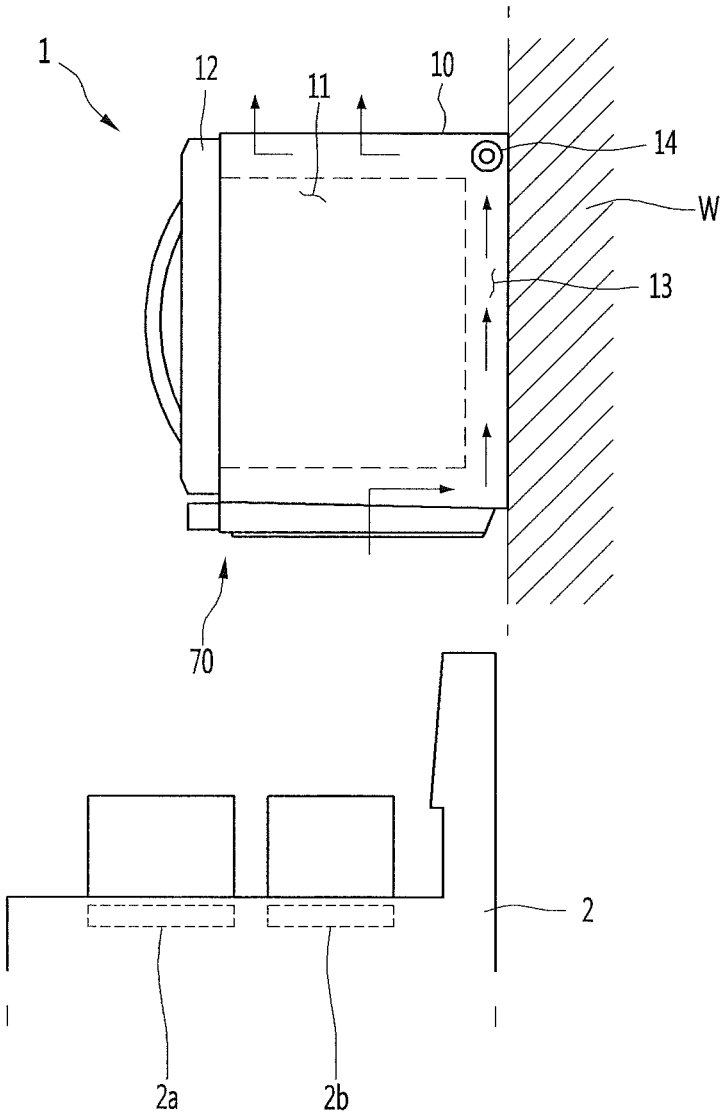
FIG. 8 is a view illustrating a cooking device according to a third embodiment of the present invention.

FIG. 8 is a view illustrating a cooking device according to a third embodiment of the present invention.

The embodiment is the same as the first embodiment, except a shape of the ventilation apparatus. Therefore, hereinafter, only a characteristic portion of the embodiment will be described.

Referring to FIG. 8, a cooking device 1 according to the third embodiment of the present invention may be installed at, for example, a wall W of a kitchen. That is, the cooking device 1 according to the embodiment of the present invention may be a wall-mounted microwave oven. Of course, as long as the cooking device 1 can be installed at the wall W, a type of the cooking device 1 is not limited.

For example, the cooking device 1 may be located above another cooking device 2 (hereinafter, referred to as a "lower cooking device") in the kitchen.

When the cooking device 1 is located above the lower cooking device 2, a user may move or locate food or a cooking container at a space between the cooking device 1 and the lower cooking device 2.

However, to prevent interference between the user and the cooking device 1 while the food is cooked using the lower cooking device 2 or the cooking is performed in a state in which the food is located on the lower cooking device 2, a forward and backward length of the cooking device 1 may be shorter than that of the lower cooking device 2.

And the lower cooking device 2 may include a front side heating part 2*a* and a rear side heating part 2*b* to simultaneously cook a variety of foods. As described above, the forward and backward length of the cooking device 1 may be shorter than that of the lower cooking device 2. For example, at least a part of the front side heating part 2*a* may be disposed not to be vertically overlapped with the cooking device 1.

Meanwhile, while the food is cooked by the lower cooking device 2, air around the lower cooking device 2 is contaminated, and the contaminated air has a higher temperature than that of other air therearound, and thus rises.

When the contaminated air rises and remains in the kitchen in which the cooking devices 1 and 2 are located, a pleasant environment in the kitchen is degraded, and smell contained in the contaminated air permeates the kitchen, and thus long hours of ventilation is required.

Therefore, the cooking device 1 may further include a ventilation apparatus 70 which suctions the contaminated air generated while the food is cooked by the lower cooking device 2 and discharges the suctioned air to an outside of the cooking device 1.

The ventilation apparatus 70 may be disposed at a lower side of the main body 10, but is not limited thereto. The main body 10 may have an exhaust port (not shown) through which air flowing in the ventilation apparatus 70 is discharged.

And the main body 10 may further include a suction fan 14 which is operated to suction the contaminated air, and an air path 13 through which the contaminated air flows. Therefore, the contaminated air suctioned by the ventilation apparatus 70 may flow through the air path 13 inside the main body 10, and then may be discharged through the exhaust port. In this case, although not illustrated, one or more filters for filtering the air or removing the smell may be provided at the air path 13 of the cooking device 1.

Alternatively, in a state in which the ventilation apparatus 70 is installed at the main body 10, the ventilation apparatus 70 may be disposed so that the exhaust port thereof is in communication with an exhaust hole formed at the wall. The ventilation apparatus 70 may be operated separately from a cooking operation in the main body 10. That is, only the cooking operation may be performed in the cooking device 1, only a ventilating operation may be performed in the cooking device 1 by the ventilation apparatus 70, or the cooking and ventilating operations may be simultaneously performed.

When the ventilation apparatus 70 is installed at a lower side of the cooking device 1, due to limitation of the forward and backward length of the cooking device 1, the ventilation apparatus 70 may be disposed to be vertically overlapped with the rear side heating part 2*b* of the lower cooking device 2, but may be disposed not to be vertically overlapped with at least a part of the front side heating part 2*a*.

In this case, if the ventilation apparatus 70 has only a simple suction function, the ventilation apparatus 70 may suction the contaminated air generated by the rear side heating part 2*b* of the lower cooking device 2, but may not suction the contaminated air generated by the front side heating part 2*a*. In this case, the contaminated air which is not suctioned by the ventilation apparatus 70 may rise toward a front space of the cooking device 1.

As described above, when the contaminated air rises toward the front space of the cooking device 1, the contaminated air may spread in the kitchen in which the cooking devices 1 and 2 are located, and thus the pleasant environment in the kitchen may be degraded.

Therefore, to enable the ventilation apparatus 70 to prevent the contaminated air generated while the food is cooked by the front side heating part 2*a* of the lower cooking device 2 from rising toward the front space of the cooking device 1, it is necessary for the ventilation apparatus 70 to have a blocking function.

Hereinafter, the ventilation apparatus 70 will be described in detail.

Figure 9:
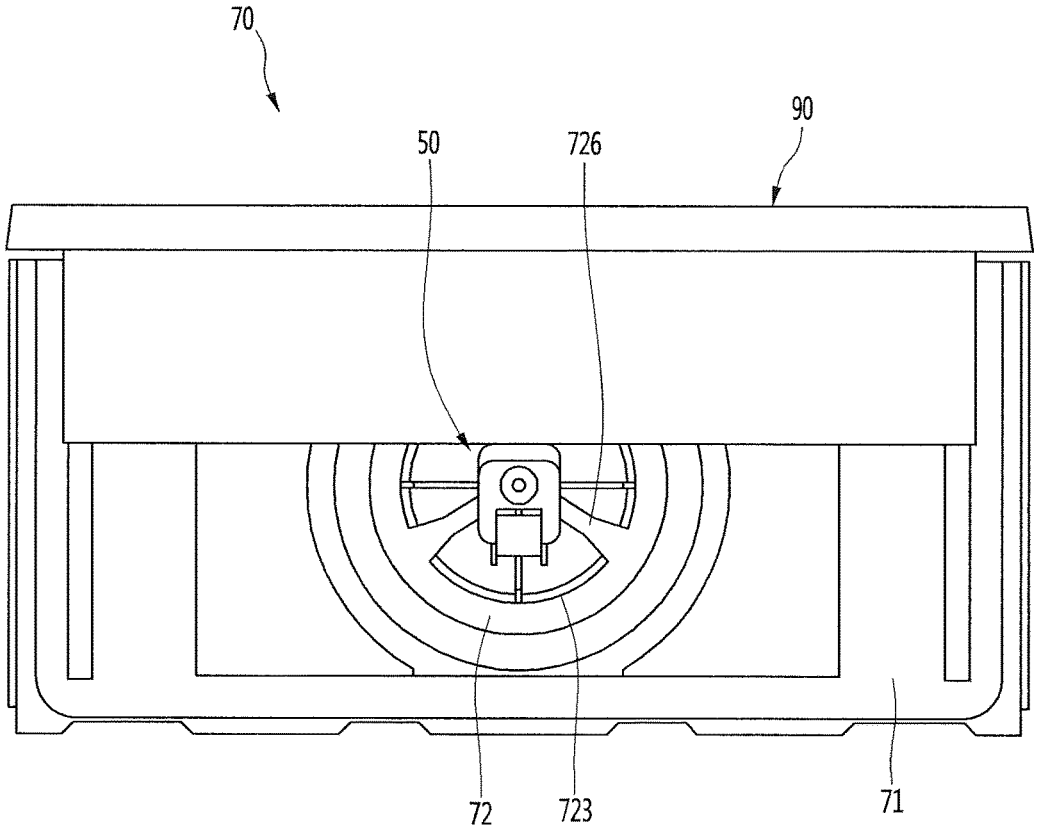
FIG. 9 is a plan view of a ventilation apparatus according to the third embodiment of the present invention while a movable member is inserted.
Figure 10:
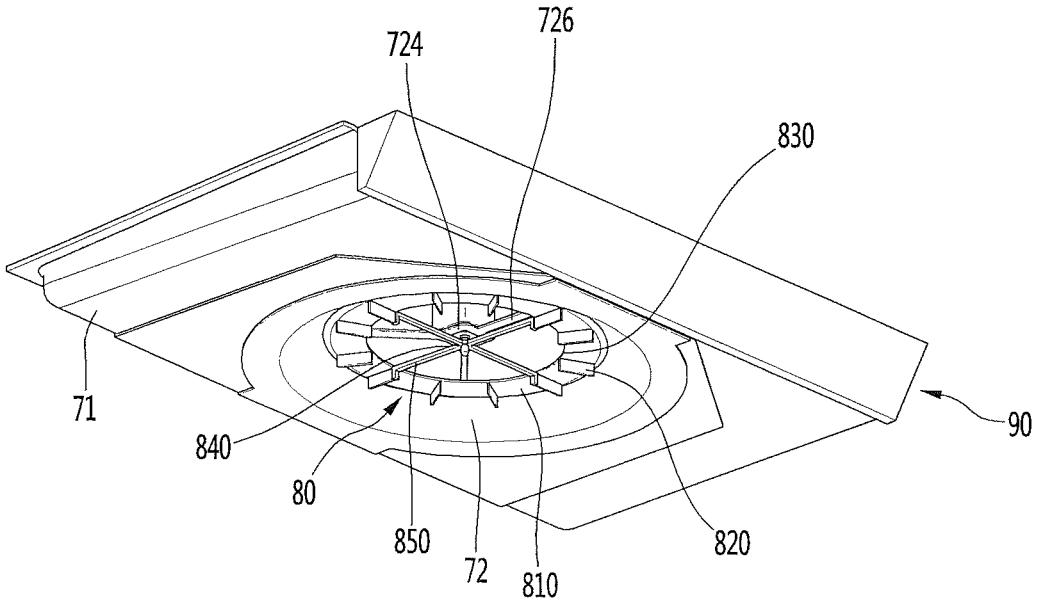
FIG. 10 is a perspective view of the ventilation apparatus according to the third embodiment of the present invention while the movable member is inserted.
Figure 11:
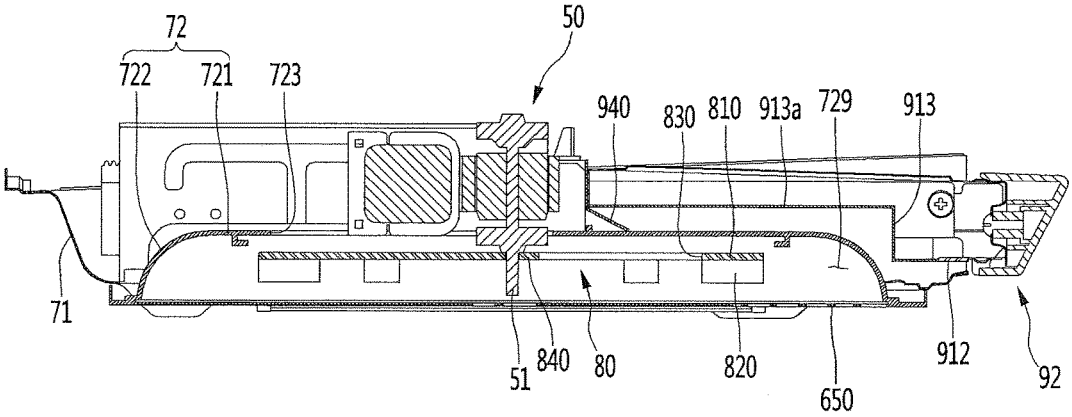
FIG. 11 is a cross-sectional view of the ventilation apparatus according to the third embodiment of the present invention while the movable member is inserted.

FIG. 9 is a plan view of the ventilation apparatus according to the third embodiment of the present invention while a movable member is inserted, FIG. 10 is a perspective view of the ventilation apparatus according to the third embodiment of the present invention while the movable member is inserted, and FIG. 11 is a cross-sectional view of the ventilation apparatus according to the third embodiment of the present invention while the movable member is inserted.

Figure 12:
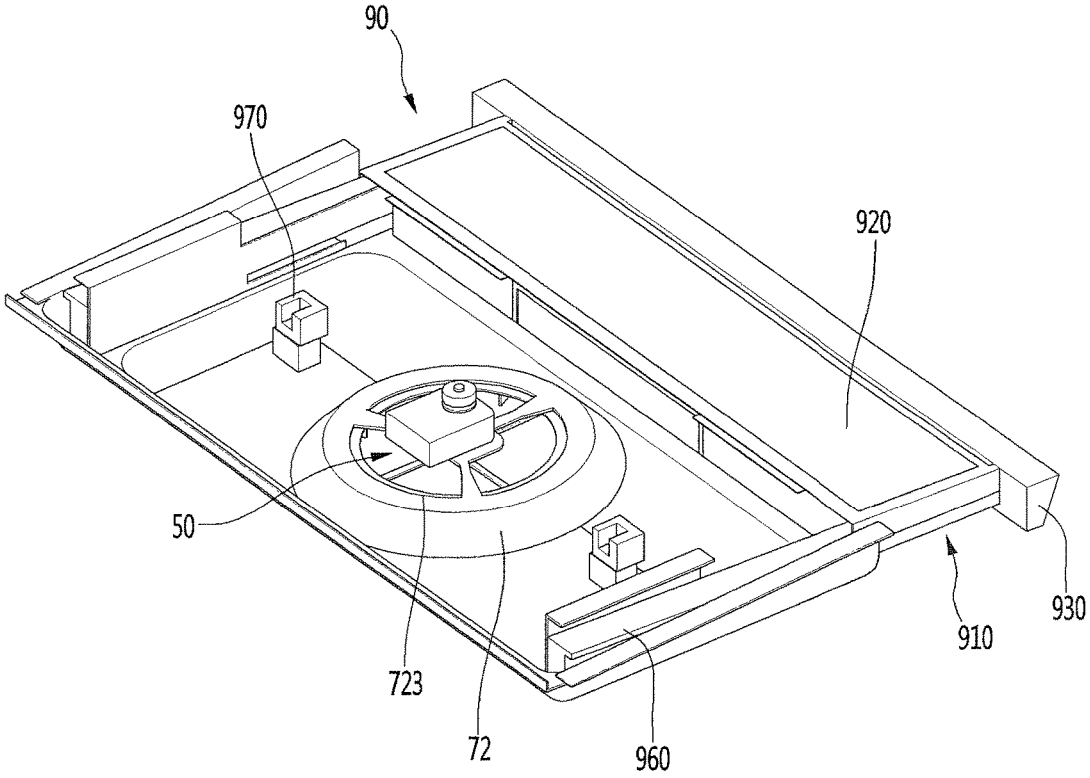
FIG. 12 is a perspective view illustrating an upper structure of the ventilation apparatus according to the third embodiment of the present invention while the movable member is withdrawn.
Figure 13:
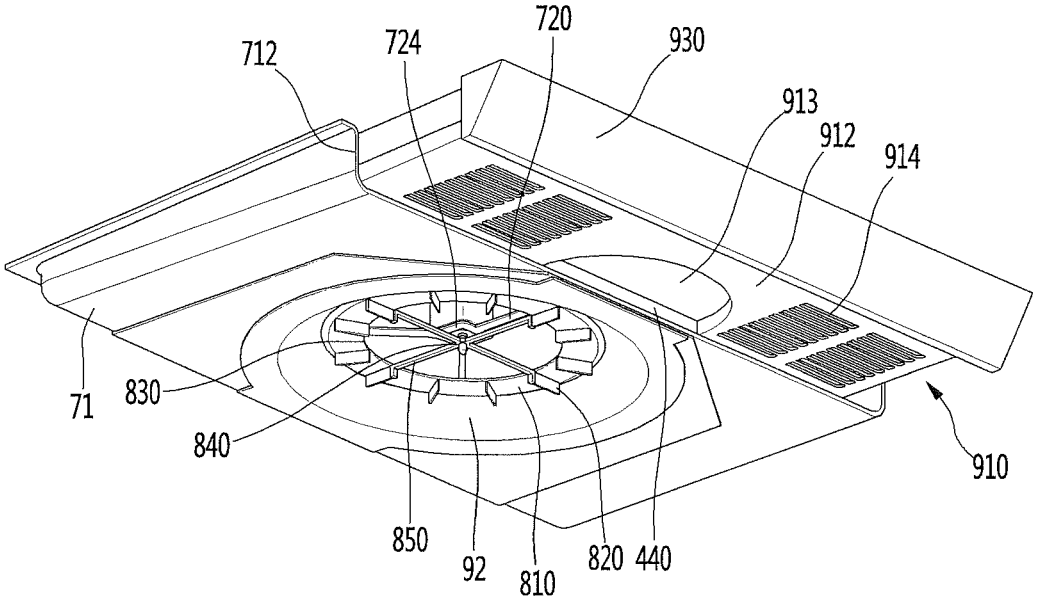
FIG. 13 is a perspective view illustrating a lower structure of the ventilation apparatus according to the third embodiment of the present invention while the movable member is withdrawn.
Figure 14:
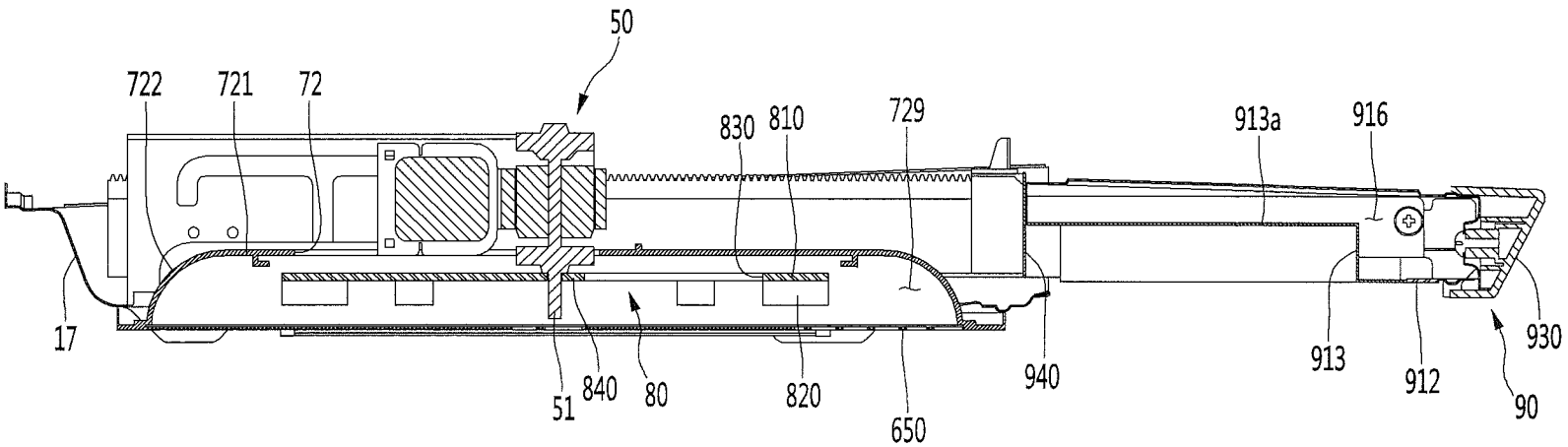
FIG. 14 is a cross-sectional view of the ventilation apparatus according to the third embodiment of the present invention while the movable member is withdrawn.

Also, FIG. 12 is a perspective view illustrating an upper structure of the ventilation apparatus according to the third embodiment of the present invention while the movable member is withdrawn, FIG. 13 is a perspective view illustrating a lower structure of the ventilation apparatus according to the third embodiment of the present invention while the movable member is withdrawn, and FIG. 14 is a cross-sectional view of the ventilation apparatus according to the third embodiment of the present invention while the movable member is withdrawn.

FIGS. 10 to 13 illustrate a state in which a swirler cover according to the embodiment is removed.

Referring to FIGS. 9 to 14, the ventilation apparatus 70 according to the embodiment serves to introduce the contaminated air and to guide the introduced contaminated air to the air path 13 of the main body 10.

The ventilation apparatus 70 may include a base 71 which provides a contaminated air path.

The base 71 may be coupled to the lower side of the main body 10, and an internal space of the base 71 may be in communication with the air path 13 inside the main body 10.

Since the base 71 forms a lower exterior of the cooking device 1, and also provides the contaminated air path, the ventilation apparatus 70 may have a simple structure.

The base 71 may include a flow guide 72 having an introduction port 723 through which the air is introduced. The flow guide 72 may be fastened to the base 71 by a fastening member, or may be integrally formed with the base 71.

The ventilation apparatus 70 may further include a driving motor 50, and a swirler 80 which receives power from the driving motor 50 so as to be rotated.

The swirler 80 may include a rotary plate 810, and a plurality of wings 820 which are disposed along an edge of the rotary plate 810 in a circumferential direction thereof. At this time, each of the plurality of wings 820 may extend downward from a lower surface of the rotary plate 810 in order to radially push out some of the air before the air passes through the rotary plate 810.

The swirler 80 may be located at a space 729 formed by the flow guide 72. And the swirler 80 may be located under the introduction port 723 so that swirl is formed under the flow guide 72 by the swirler 80.

Specifically, to allow the swirl to be formed under the flow guide 72 by the swirler 80 while the swirler 80 is rotated, the flow guide 72 may include a first surface 721 which is formed to be recessed upward from a lower surface of the base 71, and a second surface 722 which connects the first surface 721 with the lower surface of the base 71.

When the swirler 80 is rotated in one direction, the wings 820 of the swirler 80 push out some of the contaminated air flowing toward a hole 830 of the rotary plate 810 in a radial direction of the rotary plate 810.

At this time, when the air which is pushed out in the radial direction flows downward in a direction which becomes far away radially, the swirl may be formed under the flow guide 72.

Therefore, to allow the air which is pushed out in the radial direction to flow downward, the second surface 722 may be an inclined surface which is inclined downward and outward from the first surface 721. The second surface 722 may be a rounded surface or a flat surface, but is not limited thereto. That is, since the second surface 722 is formed as the rounded surface or the flat surface, the air which is pushed out in the radial direction may smoothly flow downward.

As described above, since the flow guide 72 includes the second surface 722 which is the inclined surface, a flow direction of the air which is pushed out in the radial direction of the rotary plate 810 by the wings 820 is changed downward by the second surface 722.

Like this, since the air which is pushed out by the wings 820 flows along the second surface 722, the air deviated from the second surface 722 of the ventilation apparatus 70 may flow downward to be inclined.

And when the contaminated air passes through the introduction port 723 of the base 71, not only the contaminated air passing through the introduction port 723 but also the air therearound are intended to pass through the introduction port 723 of the base 71. Due to such a flow of the air, the swirl may be formed under the swirler 80.

That is, since the flow guide 72 of the base 71 guides downward the air flowing in a radial direction of the swirler 80, the swirl may be effectively formed under the swirler 80.

Meanwhile, the introduction port 723 may be formed at the first surface 721. Therefore, while the swirler 80 is rotated, some of the air may be pushed out in the radially direction by the wings 820 before the air is introduced into the introduction port 723.

The hole 830 through which the contaminated air passes may be formed at the rotary plate 810. To allow the swirl to be smoothly formed at a lower side of the ventilation apparatus 70 by the air pushed out from an end of each of the wings 820, the entire swirler 80 may be located inside the space 729 formed by the flow guide 72, and a recessed depth of the flow guide 72 may be greater than a height of each of the wings 820.

The swirler 80 may further include a shaft coupling part 840 for connection with a shaft 51 of the driving motor 50, and one or more connection ribs 850 which connect the shaft coupling part 840 with the rotary plate 810.

For a smooth flow of the contaminated air, the hole 830 may be disposed to be vertically overlapped with the introduction port 723 of the base 71. And the shaft coupling part 840 may be located inside the hole 830 of the rotary plate 810.

Accordingly, the air flowing in an axial direction of the swirler 80 may pass through the hole 830 and the introduction port 723 without a change of direction, and then may be introduced into the ventilation apparatus 70, and thus a distance between the hole 830 and the introduction port 723 may be reduced.

An installation part 724 at which the driving motor 50 is installed may be provided at the flow guide 72. The installation part 724 may include a connection portion 726 which connects the installation part 724 with the first surface 721 of the flow guide 72.

The driving motor 50 may be installed at an upper side of the installation part 724. In order for the shaft 51 of the driving motor 50 to be fastened to the swirler 80 while the driving motor 50 is installed at the installation part 724, the shaft 51 of the driving motor 50 may pass through the introduction port 723.

Also, in order for the height of the ventilation apparatus 70 to be reduced while the driving motor 50 is installed at the installation part 724, at least a part of the driving motor 50 may be accommodated inside the main body 10.

Therefore, according to the embodiment, since the driving motor 50 is installed at the installation part 724 provided at the base 71, the driving motor 50 may be easily installed.

Also, since the swirler 80 is located in the space 729 which is recessed from the base 71, and the shaft 51 of the driving motor 50 passes through the introduction port 723 of the base 71, and is coupled to the swirler 80, and at least a part of the driving motor 50 is located inside the main body 10, the height of the ventilation apparatus 70 may be reduced.

Meanwhile, the ventilation apparatus 70 may further include a swirler cover 650 which covers the swirler 80 at a lower side of the swirler 80.

For example, the swirler cover 650 may be fastened to the base 71. The swirler cover 650 may be a filter which primarily filters the air.

Since the swirler cover 650 covers the swirler 80, a user's access from an outside to the swirler 80 is prevented, and thus user safety is ensured.

Also, since the swirler cover 650 covers the swirler 80, the access to the swirler 80 may be easily performed by separating the swirler cover 650 to repair or check the swirler 80.

The ventilation apparatus 70 may further include a movable member 90 which is movably connected to the base 71 to block rising of the contaminated air generated while the food is cooked by the lower cooking device 2.

Specifically, the movable member 90 may block the rising of the contaminated air generated while the food is cooked by the front side heating part 2*a* of the lower cooking device 2.

The movable member 90 may be inserted into the base 71 to be prevented from being exposed to an outside when the cooking operation using the lower cooking device 2 is not performed. And the movable member 90 may be withdrawn from the base 71 to a front of the cooking device 1 so as to block the rising of the contaminated air generated while the food is cooked by the front side heating part 2*a* of the lower cooking device 2.

At this point, to effectively prevent the rising of the contaminated air generated while the food is cooked by the front side heating part 2*a* of the lower cooking device 2, the movable member 90 may be vertically overlapped with the front side heating part 2*a* while being withdrawn from the base 71.

An opening 712 through which the movable member 90 is inserted and withdrawn may be provided at the base 71.

The movable member 90 may include a first frame 910 which blocks the rising of the contaminated air, and a second frame 930 which is provided at a front side of the first frame 910 to be gripped by the user.

The first frame 910 may be slidably connected to the base 71 by a rail assembly 960.

The first frame 910 may be inserted into the base 71, and at least a part of the second frame 930 may be disposed at an outside of the base 71 while the first frame 910 is inserted into the base 71.

Therefore, when the user pulls the second frame 930 while gripping the second frame 930, the first frame 910 may be withdrawn from the base 71.

While the first frame 910 is inserted into the base 71, the first frame 910 is fixed by a fixing unit 970 which is provided at the base 71. Therefore, a state in which the first frame 910 is inserted into the base 71 may be maintained by the fixing unit 970.

The first frame 910 may further include an introduction port 914 through which some of the rising contaminated air is introduced.

A guide path 916 may be formed at the first frame 910 so that the air passed through the introduction port 914 is guided to an internal space of the base 71.

To form the guide path 916, the first frame 910 may include a lower frame 912, and an upper frame 920 which is coupled to the lower frame 912, but is not limited thereto. And the introduction port 914 may be provided at the lower frame 912.

Hereinafter, the introduction port 723 provided at the base 71 may be referred to as a "first introduction port", and the introduction port 914 provided at the movable member 90 may be referred to as a "second introduction port".

In this case, the second introduction port 914 may be located at a front of the cooking device 1 further than the first introduction port 723. Like this, when the second introduction port 914 is located at the front of the cooking device 1 further than the first introduction port 723, the contaminated air generated while the food is cooked by the front side heating part 2*a* of the lower cooking device 2 may be introduced into the second introduction port 914.

To allow the air to be smoothly introduced through the second introduction port 914, a height of the guide path 916 should be high. In the embodiment, to increase the height of the guide path 916, the lower frame 912 may be located as close as possible to the lower surface of the base 71. For example, the second introduction port 914 of the movable member 90 may be located lower than the first introduction port 723 of the base 71.

Due to such an arrangement of the introduction ports, the contaminated air generated while the food is cooked at the front side heating part 2*a* of the lower cooking device 2 may be quickly introduced into the second introduction port 914 before spreading around the cooking device 1.

Also, since the contaminated air may be introduced through each of the first introduction port 723 and the second introduction port 914, an introduction area of the contaminated air is increased, and introduction performance is enhanced, and thus a ventilation speed of the contaminated air may also be enhanced.

Since the flow guide 72 is located at the base 71, the lower frame 912 may interfere with the flow guide 72 when the lower frame 912 is located as close as possible to the lower surface of the base 71 and the movable member 90 is inserted into the base 71.

Therefore, in the embodiment, a recessed portion 913 which prevents interference with the flow guide 72 may be provided at the lower frame 912. The recessed portion 913 may be formed by recessing upward a part of the lower frame 912.

According to a structure of the present invention as described above, the height of the guide path 916 may be maximum at the movable member 90, and the interference between the first frame 910 and the flow guide 72 may be prevented while the first frame 910 is inserted into the base 71.

Referring to FIG. 11, while the first frame 910 is inserted into the base 71, a recessed surface 913*a* of the recessed portion 913 is located higher than the first surface 721 of the flow guide 72, and spaced apart from each other so as to prevent the interference with the flow guide 72.

According to such a structure, while the first frame 910 is withdrawn to an outside of the base 71 as illustrated in FIG. 14, a structure inside the base 71 is exposed to an outside through the recessed portion 913 of the first frame 910 and the opening 712 of the base 71.

In this case, an esthetic sense of the cooking device 1 may be reduced, and also the user's hand may be inserted into the base 71 through the recessed portion 913 and the opening 712 of the base 71.

Therefore, to prevent the structure inside the base 71 from being exposed to the outside and also to prevent the user's hand from being inserted into the base 71 while the movable member 90 is withdrawn from the base 71, the movable member 90 may further include a blocking member 940.

For example, the blocking member 940 may be rotatably installed at the lower frame 912, and may be located at the recessed portion 913. And the blocking member 940 may block at least a part of the opening 712.

At this point, while the first frame 910 is inserted into the base 71, the second frame 930 may block the opening 712.

While the movable member 90 is withdrawn from the base 71, an end of the blocking member 940 may be located at the same height as that of the lower surface of the base 71, or may be located lower than the lower surface of the base 71 so that the user's hand is effectively prevented by the blocking member 940 from being inserted into the base 71 through the opening 712.

And in a process in which the first frame 910 is being inserted into the base 71, for example, the blocking member 940 may be rotated counterclockwise, and prevented from interfering with the flow guide 72, and may be maintained in a contacting state with the first surface 721 of the flow guide 72.

As described above, since the blocking member 940 is rotatably installed at the lower frame 912, it is not necessary for the user to operate the blocking member 940, and thus user convenience may be enhanced.

The blocking member 940 may block the flow of the air through the opening 712 of the base 71. Also, the blocking member 940 may allow the flow of the air through the opening 712 of the base 71.

In order for the blocking member 940 to allow the flow of the air, the blocking member 940 may also have one or more holes for the flow of the air.

Hereinafter, an operation of the ventilation apparatus 70 will be described.

Figure 15:
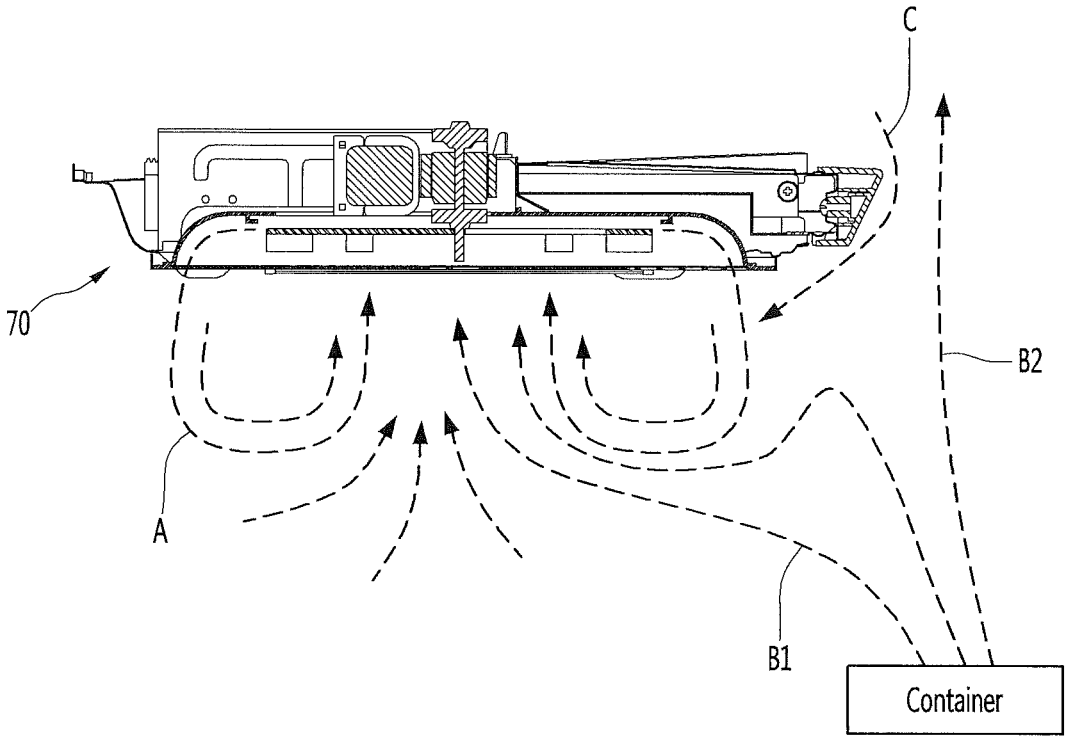
FIG. 15 is a view illustrating a flow of air generated when the ventilation apparatus is operated while the movable member is not withdrawn.
Figure 16:
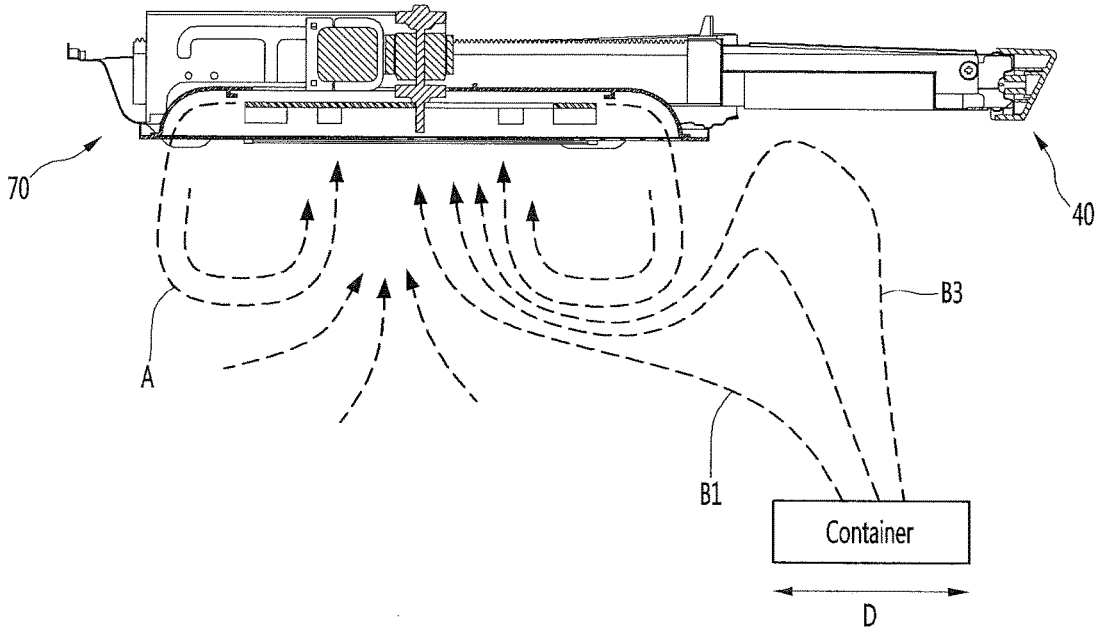
FIG. 16 is a view illustrating the flow of the air generated when the ventilation apparatus is operated while the movable member which does not have an introduction port is withdrawn.
Figure 17:
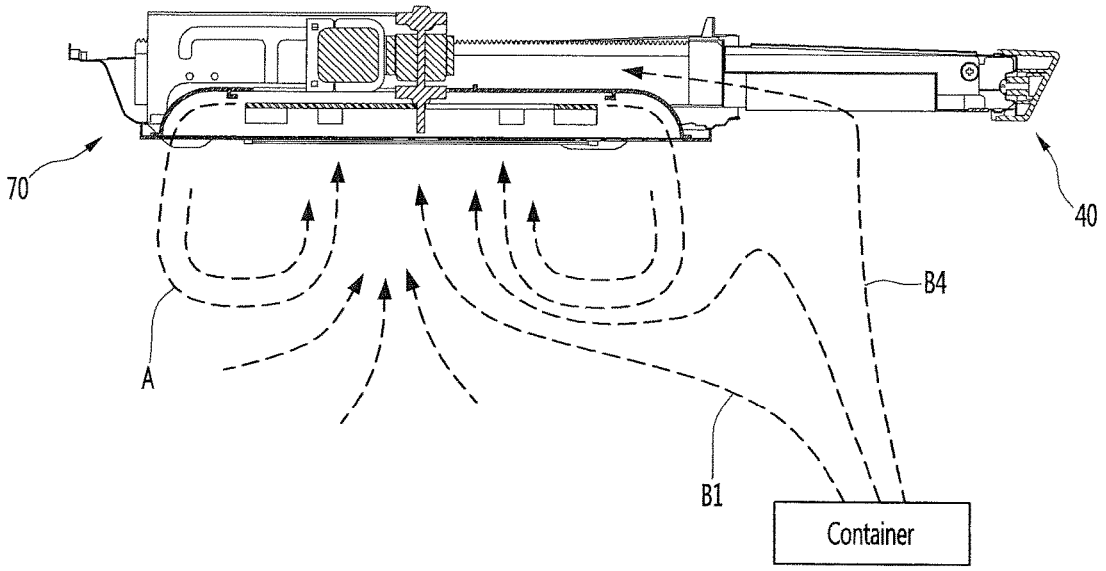
FIG. 17 is a view illustrating the flow of the air generated when the ventilation apparatus is operated while the movable member which has the introduction port is withdrawn.

FIG. 15 is a view illustrating the flow of the air generated when the ventilation apparatus is operated while the movable member is not withdrawn, FIG. 16 is a view illustrating the flow of the air generated when the ventilation apparatus is operated while the movable member which does not have an introduction port is withdrawn, and FIG. 17 is a view illustrating the flow of the air generated when the ventilation apparatus is operated while the movable member which has the introduction port is withdrawn.

First, referring to FIG. 15, when an operation command of the ventilation apparatus 70 is input, the driving motor 50 is turned on. When the driving motor 50 is turned on, the swirler 80 is rotated in one direction.

For example, when the operation command of the ventilation apparatus 70 is input through a separate input part, or withdrawing of the movable member 90 is detected by a detection part which is not illustrated, the operation command may be input. In the embodiment, an operation time of the ventilation apparatus 70 is not limited.

When the swirler 80 is rotated in one direction, the wings 820 of the swirler 80 push out some of the contaminated air flowing toward the hole 830 of the rotary plate 810 in the radial direction of the rotary plate 810.

At this point, since the flow guide 72 includes the second surface 722 which is the inclined surface, the flow direction of the air which is pushed out in the radial direction of the rotary plate 810 by the wings 820 is changed downward by the second surface 722.

As the air which is pushed out by the wings 820 flows along the second surface 722, the air deviated from the second surface 722 of the ventilation apparatus 70 flows downward to be inclined as illustrated in the drawing.

And when the contaminated air passes through the introduction port 723 of the base 71, not only the contaminated air passing through the introduction port 723 but also the air therearound are intended to pass through the introduction port 723 of the base 71. Due to such a flow of the air, the swirl is formed under the swirler 80.

Like the present invention, when the swirl is formed under the swirler 80 by the swirler 80 and the flow guide 72, the contaminated air which rises from a lower side of the cooking device 1 may be smoothly introduced into the ventilation apparatus 70.

At this point, in the case of the embodiment, the flow guide 72 of the base 71 guides downward the air flowing in the radial direction of the swirler 80, and thus the swirl may be effectively formed.

Referring to FIG. 15, a portion (referring to B1) of the contaminated air is discharged from the ventilation apparatus 70 in the radial direction of the ventilation apparatus 70

(referring to A) while flowing by the swirler 80, and thus the swirl is formed under the swirler 80.

However, while the movable member 90 is inserted into the base 71, another portion (B2) of the contaminated air may not be introduced into the ventilation apparatus 70, but may rise along a front surface of the cooking device 1, and a collection rate (a rate of the contaminated air which is introduced into the ventilation apparatus among the entire contaminated air) of the contaminated air is lowered, and the contaminated air spreads in the kitchen, and thus the pleasant environment in the kitchen is degraded.

Also, due to the flow of the air which flows radially by the swirler 80 of the ventilation apparatus 70, the air at a front side of the ventilation apparatus 70 may flow downward (referring to C), and thus may have an influence on the swirl.

Meanwhile, referring to FIG. 16, while the movable member 90 is withdrawn to the front of the base 71, the portion (referring to B1) of the contaminated air directly flows toward the introduction port 723 of the ventilation apparatus 70, and another portion (referring to B3) of the contaminated air flows toward the movable member 90. At this point, a flowing speed of the air flowing toward the movable member 90 is reduced by the movable member 90, and thus blocked from flowing to an upper side of the movable member 90 (a blockage effect).

When the portion (referring to B3) of the contaminated air is blocked by the movable member 90 from rising, the flowing speed of the portion (referring to B3) of the contaminated air becomes almost zero, and thus the portion (referring to B3) of the contaminated air may flow toward the introduction port 723 of the ventilation apparatus 70 by an influence of the swirl.

That is, like the present invention, when the movable member 90 is withdrawn from the base 71, the rising of the contaminated air is blocked, and thus the collection rate of the contaminated air in the ventilation apparatus 70 may be enhanced.

Also, while the movable member 90 is withdrawn from the base 71, an area on which a flowing pressure of the air generated by the swirler 80 acts is increased (an effect of flange).

Specifically, while the movable member 90 is withdrawn from the base 71, a forward and backward area (an area in a direction of an arrow D) on which a pressure field acts is increased.

In this case, the contaminated air is prevented from rising from a front of the movable member 90 toward an upper side of the movable member 90, and thus an amount of the air which flows from the front or the upper side of the movable member 90 toward a lower side of the movable member 90 may be minimized.

At this point, when the introduction port is not provided at the movable member 90, the air of which the flow direction is changed by the movable member 90 may be introduced into the ventilation apparatus 70 through the introduction port 723 of the base 71.

However, as illustrated in FIG. 17, when the introduction port is provided at the movable member 90, a portion (referring to B4) of the contaminated air may be introduced through the introduction port 914 of the movable member 90.

That is, in the case of FIG. 17, since the contaminated air may be introduced through each of the introduction port of the base and the introduction port of the movable member, the introduction area of the contaminated air is increased, and the introduction performance is enhanced, and thus the ventilation speed of the contaminated air is enhanced.

A structure of the movable member in the third embodiment may be directly applied to the ventilation apparatus in the first embodiment.

Figure 18:
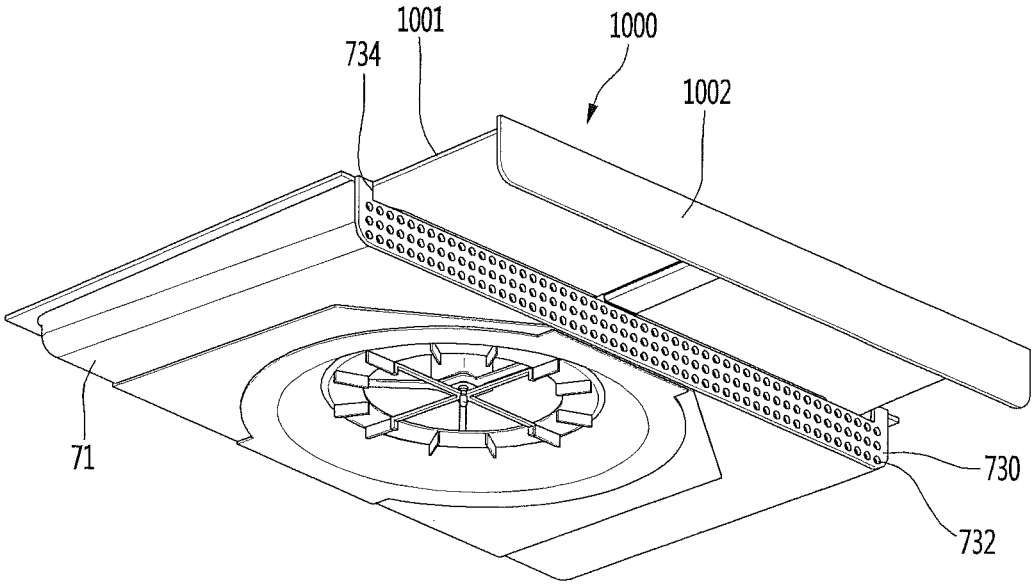
FIG. 18 is a view illustrating a ventilation apparatus according to a fourth embodiment of the present invention.

FIG. 18 is a view illustrating a ventilation apparatus according to a fourth embodiment of the present invention.

The embodiment is the same as the third embodiment, except shapes of the introduction port of the base and the movable member. Therefore, hereinafter, only a characteristic portion of the embodiment will be described.

Referring to FIGS. 8 and 18, a ventilation apparatus according to the embodiment may include a base 71. The base 71 may include a front surface plate 1030. One or more front surface introduction ports 732 through which the contaminated air is introduced may be provided at the front surface plate 1030. The one or more front surface introduction ports 732 may suction the contaminated air generated while the food is cooked by the front side heating part 2*a* of the lower cooking device 2.

The base 71 may further include a movable member 1000 which blocks rising of the contaminated air and guides the contaminated air toward the front surface introduction port 732.

The movable member 1000 may be slidably connected to the base 71. For example, the movable member 1000 may be connected to the base 71 to be withdrawn therefrom and inserted therein by the rail assembly which is described in the previous embodiment.

The movable member 1000 may include a first frame 1001 which is enabled to be inserted into the base 71, and a second frame 1002 which extends downward from the first frame 1001. The first frame 1001 may block the rising of the contaminated air.

The second frame 1002 may serve as a handle which is gripped by the user. That is, the user may grip the second frame 1002, and may push or pull the second frame 1002.

An opening 734 which prevents interference with the first frame 1001 may be provided at a front plate 730. For example, the opening 734 may be formed by cutting away a part of an upper end of the front plate 730.

Alternatively, the opening 734 may be a groove which is formed by recessing downward the part of the upper end of the front plate 730. Still alternatively, the opening 734 may be a space formed by forming a height of the front plate 730 lower than that of a side plate.

The second frame 1002 may cover the front surface introduction port 732 of the front plate 730 while the first frame 1001 is inserted into the base 71.

Therefore, since the second frame 1002 covers the front surface introduction port 732 while the first frame 1001 is inserted into the base 71, the front surface introduction port 732 is not exposed to the outside, and foreign substances are prevented from being introduced through the front surface introduction port 732, and thus an exterior may be enhanced.

In the embodiment, when the movable member is withdrawn from the base, the rising of the contaminated air is blocked, and introducing of the contaminated air into the base is guided, and thus the introduction performance may be enhanced.

According to the proposed invention, since the swirl is formed under the swirler by the swirler, the introduction performance of the contaminated air can be enhanced.

Also, since the driving motor is installed at the installation part provided at the base, the driving motor can be easily installed, and the height of the ventilation apparatus can be reduced.

In particular, since the driving motor passes through the introduction port of the base, and is located under the introduction port, the height of the ventilation apparatus can be further reduced.

Also, when the filter unit is coupled to the base, the filter unit covers the swirler, and thus the user safety can be ensured.

Also, since the filter unit includes the rounded guide surface, the air flowing by the swirler can smoothly flow downward by a Coanda effect.

Also, since the movable member is withdrawn to the front of the cooking device, the contaminated air generated when the food is cooked by another cooking device located under the cooking device is prevented from rising, and thus the introduction performance of the ventilation apparatus can be enhanced.

Also, as the movable member is withdrawn to the front of the cooking device, the area on which the flowing pressure of the ventilation apparatus acts is increased, and the air is prevented from rising from the front of the movable member toward the upper side of the movable member, and thus the amount of the air which flows from the front or the upper side of the movable member toward the lower side of the movable member can be minimized.

Also, since the air can also be introduced into the movable member, the introduction area of the ventilation apparatus is increased, and thus the ventilation performance and the ventilation speed can be enhanced.

Also, since the swirler is located in the space recessed from the base, and the shaft of the driving motor passes through the introduction port of the base, and is coupled to the swirler, and at least a part of the driving motor is located inside the main body, the height of the ventilation apparatus can be reduced.

Also, since an interference preventing part which prevents the interference with the flow guide provided at the base is provided at the movable member, the interference with the structure inside the ventilation apparatus can be prevented while the movable member is inserted into the ventilation apparatus.

Also, since the blocking member prevents the user's hand from being inserted into the opening of the base while the movable member is withdrawn, the user safety can be ensured.

A cooking device comprises a main body having a cooking space for cooking food; a base disposed at a lower side of the main body, and comprising a ventilation apparatus for suctioning and discharging contaminated air, the ventilation apparatus being connected to the lower side of the main body and having an introduction port; a swirler rotated so that the contaminated air is suctioned through the introduction port of the base, and having a plurality of wings; a driving motor installed at the base and configured to generate power for rotating the swirler; and a movable member connected to the base to be inserted and withdrawn, and configured to block rising of the contaminated air generated when food is cooked by a lower cooking device located under the ventilation apparatus, while being withdrawn from the base.

The base comprises a flow guide which guides downward a flow of air flowing by the swirler, and the swirler is located inside a space formed by the flow guide.

The movable member comprises an additional introduction port through which rising air is introduced.

The additional introduction port is located forward further than the introduction port of the base while the movable member is withdrawn from the base.

The additional introduction port is located lower than the introduction port of the base.

The movable member comprises a recessed portion which prevents interference with the flow guide while the movable member is being inserted into the base.

The base comprises a front surface plate having an opening through which the movable member is inserted and withdrawn, and the movable member further comprises a blocking member which blocks at least a part of the opening while being withdrawn through the opening.

The blocking member is rotatably connected to the movable member at the recessed portion, and a lower end of the blocking member is located lower than the introduction port while the movable member is withdrawn from the base.

A hole through which air passes is provided at the blocking member.

The movable member comprises a first frame which is able to pass through the opening, and a second frame which is provided at a front side of the first frame and blocks the opening while the first frame is inserted into the base.

The base comprises a front surface plate having an opening through which the movable member is inserted and withdrawn, and an additional introduction port through which the contaminated air is introduced is provided at the front surface plate.

The movable member comprises a first frame which is able to pass through the opening, and a second frame which is provided at a front side of the first frame and blocks the additional introduction port while the first frame is inserted into the base.

Even though all the elements of the embodiments are coupled into one or operated in the combined state, the present disclosure is not limited to such an embodiment. That is, all the elements may be selectively combined with each other without departing from the scope of the invention. Furthermore, when it is described that one comprises (or includes or has) some elements, it should be understood that it may comprise (or include or have) only those elements, or it may comprise (or include or have) other elements as well as those elements if there is no specific limitation. Unless otherwise specifically defined herein, all terms including technical or scientific terms are to be given meanings understood by those skilled in the art. Like terms defined in dictionaries, generally used terms need to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the spirit and scope of the invention as defined by the appended claims. Therefore, the preferred embodiments should be considered in a descriptive sense only and not for purposes of limitation, and also the technical scope of the invention is not limited to the embodiments. Furthermore, the scope of the invention is defined not by the detailed description of the invention but by the appended claims, and all differences within the scope will be construed as being included in the present disclosure.

What is claimed is:

1. A cooking device comprising:

a main body defining a cooking space for cooking food;

a ventilation apparatus coupled to a lower side of the main body and configured to suction and discharge air, the ventilation apparatus comprising:

a base disposed at the lower side of the main body and defining an introduction port, a swirler having a plurality of wings and configured to rotate to thereby suction air through the introduction port, the plurality of wings being configured to push out air in a radial direction, an installation part provided at the base, and a driving motor installed at the installation part and configured to rotate the swirler, wherein the base comprises a flow guide that comprises:

a first surface that defines the introduction port, and a second surface that is inclined downward from the first surface, that extends radially outward from the first surface, and that is configured to guide, in a direction downward and radially outward with respect to the first surface, a flow of air pushed out from the plurality of wings.

2. The cooking device according to claim 1, wherein the swirler is located vertically below the introduction port, and the driving motor passes through the introduction port.

3. The cooking device according to claim 2, wherein the installation part comprises a supporter that is located vertically below the introduction port and to which the driving motor is fastened, and further comprises a connection portion that connects the base with the supporter.

4. The cooking device according to claim 1, the swirler comprising:

a rotary plate that defines a hole through which air passes;

a shaft coupling part that is connected to a shaft of the driving motor; and a connection rib that connects the shaft coupling part with the rotary plate, wherein the shaft coupling part is located vertically lower than the rotary plate.

5. The cooking device according to claim 4, wherein a part of the driving motor passes through a hole of the rotary plate.

6. The cooking device according to claim 1, wherein the flow guide defines a recessed portion, and the swirler is located inside a space defined by the recessed portion.

7. The cooking device according to claim 6, further comprising a filter unit that is configured to filter the air flowing toward the introduction port, wherein the filter unit is vertically spaced apart from the swirler and covers the swirler.

8. The cooking device according to claim 7, wherein the filter unit is spaced apart from the flow guide and forms a discharge path along with the flow guide, and the filter unit comprises a rounded guide surface that is configured to guide air discharged from the discharge path.

9. The cooking device according to claim 1, further comprising a movable member that is connected to the base and configured be inserted into and withdrawn from the base along a horizontal direction, the movable member being configured, based on being withdrawn from the base, to block rising of the air from a lower cooking device located under the ventilation apparatus.

10. The cooking device according to claim 9, wherein the movable member defines an additional introduction port configured to receive the rising air.

11. The cooking device according to claim 10, wherein the additional introduction port is located forward of the introduction port of the base based on the movable member being withdrawn from the base.

12. The cooking device according to claim 9, wherein the base comprises a flow guide configured to guide downward a flow of air flowing by the swirler, and the movable member defines a recessed portion that is configured to prevent interference with the flow guide based on the movable member being inserted into the base.

13. The cooking device according to claim 9, wherein the base comprises a front surface plate defining an opening through which the movable member is inserted and withdrawn, and the movable member further comprises a blocking member that is configured to block at least a part of the opening based on the movable member being withdrawn through the opening.

14. The cooking device according to claim 9, wherein the base comprises a front surface plate defining an opening through which the movable member is inserted and withdrawn, and the movable member comprises a first frame that is configured to pass through the opening, and further comprises a second frame that is provided at a front side of the first frame and configured to block the opening based on the first frame being inserted into the base.

* * * * *